US008704746B2

(12) United States Patent
Byun

(10) Patent No.: US 8,704,746 B2
(45) Date of Patent: Apr. 22, 2014

(54) LIQUID CRYSTAL DISPLAY HAVING A VOLTAGE STABILIZATION CIRCUIT AND DRIVING METHOD THEREOF

(75) Inventor: Seung Chan Byun, Incheon (KR)

(73) Assignee: LG Display Co., Ltd., Seoul (KR)

( * ) Notice: Subject to any disclaimer, the term of this patent is extended or adjusted under 35 U.S.C. 154(b) by 764 days.

(21) Appl. No.: 11/447,077

(22) Filed: Jun. 6, 2006

(65) Prior Publication Data

US 2007/0001988 A1 Jan. 4, 2007

(30) Foreign Application Priority Data

Jun. 30, 2005 (KR) ..... 10-2005-0058217

(51) Int. Cl.
*G09G 3/36* (2006.01)

(52) U.S. Cl.
USPC ..... 345/100

(58) Field of Classification Search
USPC ..... 345/87, 98–100, 211–213; 349/149–152
See application file for complete search history.

(56) References Cited

U.S. PATENT DOCUMENTS

| | | | | |
|---|---|---|---|---|
| 5,602,560 | A * | 2/1997 | Ikeda | 345/94 |
| 2002/0011982 | A1 * | 1/2002 | Takeuchi et al. | 345/92 |
| 2004/0125308 | A1 * | 7/2004 | Park et al. | 349/149 |
| 2004/0263447 | A1 * | 12/2004 | Hong et al. | 345/87 |
| 2004/0263758 | A1 * | 12/2004 | Lee et al. | 349/150 |
| 2005/0219432 | A1 * | 10/2005 | Na et al. | 349/40 |

FOREIGN PATENT DOCUMENTS

WO WO 2004/049295 A1 6/2004

* cited by examiner

*Primary Examiner* — Rodney Amadiz
(74) *Attorney, Agent, or Firm* — Morgan, Lewis & Bockius LLP

(57) ABSTRACT

A line-on-glass liquid crystal display device includes data lines for supplying data signals to drive sub-pixel units on a substrate, gate lines for supplying gate signals, and a gate low voltage stabilization circuit connected to a gate low voltage line from a data printed circuit board for applying a gate low voltage signal to the sub-pixel units.

2 Claims, 5 Drawing Sheets

LIQUID CRYSTAL DISPLAY HAVING A VOLTAGE STABILIZATION CIRCUIT AND DRIVING METHOD THEREOF

This application claims the benefit of the Korean Patent Application No. P2005-0058217 filed on Jun. 30, 2005 which is hereby incorporated by reference in its entirety.

BACKGROUND OF THE INVENTION

1. Field of the Invention

The present invention relates to a liquid crystal display device, and more particularly to a line-on-glass liquid crystal display apparatus and driving method thereof. Although the present invention is suitable for a wide scope of applications, it is particularly suitable for stably supplying a gate low voltage signal.

2. Description of the Related Art

In general, liquid crystal display (LCD) devices are non-emissive display devices and are commonly used in notebook and desktop computers because of their high resolution, color rendering capability, and high quality image display. A liquid crystal display device controls the light transmittance of liquid crystal using an electric field, thereby displaying a picture. To this end, the liquid crystal display device includes a liquid crystal display panel in which liquid crystal cells are arranged in a matrix shape and a drive circuit for driving the liquid crystal display panel.

In the liquid crystal display panel, gate lines and data lines are arranged to cross each other, and sub-pixel units are located in areas defined by the crossing of the gate lines and the data lines. A common electrode is provided for all of the sub-pixel units. A pixel electrode is provided in each of the sub-pixel units. Each of the pixel electrodes is connected to one of the data lines through source and drain electrodes of a thin film transistor, which is a switching device within the sub-pixel unit corresponding to the pixel electrode. A gate electrode of the thin film transistor is connected to one of the gate lines.

The drive circuit includes a gate driver for driving the gate lines; a data driver for driving the data lines; a timing controller for controlling the gate driver and the data driver; and a power supply for supplying various drive voltages, which are used in the liquid crystal display (LCD) device. The timing controller controls drive timing of the gate driver and the data driver, and supplies a pixel data signal to the data driver. The power supply generates drive voltages, such as common voltage VCOM, gate high voltage VGH, and gate low voltage VGL, which are required to operate the liquid crystal display device.

The gate driver sequentially supplies a scan signal to the gate lines to sequentially drive the liquid crystal cells of the liquid crystal display panel, line by line. The data driver supplies a pixel voltage signal to each of the data lines while the scan signal is supplied to one of the gate lines. Accordingly, the liquid crystal display device controls the light transmittance by using electric fields applied between the pixel electrodes and the common electrode in accordance with the pixel voltage signals to each of the sub-pixel units, thereby displaying a picture.

The data driver and the gate driver are connected to the liquid crystal display panel. The data driver and the gate driver can be implemented as a plurality of integrated circuits (ICs). Both the data drive IC and the gate drive IC are mounted on a tape carrier package (TCP) connected to the liquid crystal display panel by a tape automated bonding (TAB) method or are mounted on the liquid crystal display panel by a chip on glass (COG) method.

The drive IC's connected to the liquid crystal display panel by the TAB method through the TCP are connected to each other and receive control signals and DC voltages input from the outside through the signal lines mounted on a printed circuit board (PCB), which is connected to the TCP. The data drive IC's are connected in series through signal lines on a data PCB and commonly receive a pixel data signal and control signals from the timing controller as well as drive voltages from the power supply. The gate drive IC's are connected in series through signal lines on a gate PCB and commonly receive the control signals from the timing controller and the drive voltages from the power supply. The drive IC's mounted on the liquid crystal display panel by the COG method are connected to each other by a line-on-glass (hereinafter, referred to as 'LOG') method where the signal lines are mounted directly on the liquid crystal display panel, such as a lower glass substrate of the LCD device, and receive the control signals and the drive voltages from the timing controller and the power supply.

Recently, even when drive IC's are being connected to the liquid crystal display panel by the TAB method, the PCB is removed by adopting the LOG method such that the LCD device can be made thinner. The signal lines connected to the gate drive IC's, which require relatively few signal lines, are formed on the liquid crystal display panel by the LOG method, thereby eliminating the need for the gate PCB. In other words, the gate drive IC's connected to the liquid crystal display panel by the TAB method are interconnected through signal lines mounted on the lower glass of the liquid crystal display panel, and commonly receive the control signals and the drive voltage signals (hereinafter, referred to as 'gate drive signals').

FIG. 1 is a plan view of a line-on-glass liquid crystal display device of the related art. A liquid crystal display device where LOG signal lines are used instead of the gate PCB, as shown in FIG. 1, includes: a liquid crystal display panel 1; a plurality of data TCP's 8 connected between the liquid crystal display panel 1 and a data PCB 12; a plurality of gate TCP's 14 connected to another side of the liquid crystal display panel 1; data drive IC's 10 mounted on the data TCP's 8 respectively; and gate drive IC's 16 mounted on the gate TCP's 14, respectively.

The liquid crystal display panel 1 includes a lower substrate 2 on which a thin film transistor array is formed together with various signal lines; an upper substrate 4 on which a color filter array is formed; and liquid crystal injected between the lower substrate 2 and the upper substrate 4. In such a liquid crystal display panel 1, there is provided a picture display area 21 having sub-pixel units provided in areas between the crossing gate lines 20 and data lines 18. In an outer area of the lower substrate 2, which is located outside of the picture display area 21, data pads connected to the data lines 18 and gate pads connected to the gate lines 20 are provided. Further, a LOG signal line group 26 for transmitting the gate drive signals, which are supplied to the gate drive IC 16, is provided in the outer area of the lower substrate 2.

The data drive IC 10 is mounted on the data TCP 8, and input pads 24 and output pads 25 electrically connected to the data drive IC 10 are provided on the data TCP 8. The input pads 24 of the data TCP 8 are electrically connected to the output pads of the data PCB 12 through an anisotropic conductive film (hereinafter, referred to as 'ACF'), and the output pads 25 of the data TCP 8 are electrically connected to the data pads on the lower substrate 2 through the ACF. A gate drive signal transmission group 22 is electrically connected to the LOG signal line group 26 on the lower substrate 2 is also provided on a first data TCP 8. The gate drive signal transmission group 22 supplies the gate drive signals of the timing controller and the power supply to the LOG signal line group 26 from the data PCB 12. The data drive IC's 10 convert the pixel data signal from a digital signal into a pixel voltage signal, which is an analog signal, and then supplies the pixel voltage signal to the data lines 18 of the liquid crystal display panel.

The gate drive IC 16 is mounted on the gate TCP 14, and a gate drive signal transmission line group 28 and output pads 30 are electrically connected to the gate drive IC 16 provided on the gate TCP 14. The gate drive signal transmission line group 28 is electrically connected to the LOG signal line group 26 on the lower substrate 2 through the ACF, and the output pads 30 are electrically connected to the gate pads on the lower substrate 2 through the ACF. The gate drive IC's 16 sequentially supply a scan signal, such as a gate high voltage signal VGH, to the gate lines 20 in response to the input control signals. Further the gate drive IC's 16 supply a gate low voltage signal VGL to the gate lines, except for the period when the gate high voltage signal VGH is supplied.

The LOG signal line group 26 includes signal lines that supply DC voltage signals from the power supply, such as the gate high voltage signal VGH, the gate low voltage signal VGL, a common voltage signal VCOM, a ground voltage signal GND and a power voltage signal VCC. Further, the LOG signal line group 26 also includes signal lines that supply and gate control signals from the timing controller, such as a gate start pulse GSC, a gate shift clock signal GSC and a gate enable signal GOE.

FIG. 2 is an equivalent circuit of a vertically adjacent gate line and a data line of a sub-pixel region in a related art liquid crystal display device. As shown in FIG. 2, in the case of a specific signal applied to the data line (data), there can be a high voltage difference between the data line (data) and the gate line. In the case of data having a high brightness difference between adjacent pixels in a vertical direction, a return current is generated in the gate line due to the coupling between the data line and the gate line by a parasitic capacitance. Such a return current may slightly turn on the vertically adjacent sub-pixel when the sub-pixel is receiving a pixel voltage signal from the data line so that the vertically adjacent sub-pixel unit receives an incorrect pixel voltage signal or a portion thereof. Thus, the generation of such a return current degrades picture quality due to the fact that a voltage of a sub-pixel unit is linked to a voltage of another sub-pixel unit, which is adjacent in the vertical direction.

SUMMARY OF THE INVENTION

Accordingly, the present invention is directed to a line-on-glass liquid crystal display apparatus and driving method thereof that substantially obviate one or more of the problems due to limitations and disadvantages of the related art.

Accordingly, it is an object of the present invention to provide a line-on-glass liquid crystal display apparatus and driving method thereof that prevent a return current due to a parasitic capacitance between a data line and a gate line.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a line-on-glass liquid crystal display device includes data lines for supplying data signals to drive sub-pixel units on a substrate, gate lines for supplying gate signals, and a gate low voltage stabilization circuit connected to a gate low voltage line from a data printed circuit board for applying a gate low voltage signal to the sub-pixel units.

In another aspect, a driving method of a line-on-glass liquid crystal display device includes charging a data voltage onto a first sub-pixel unit by supplying a gate high voltage to a first thin film transistor connected to an (n−1)th gate line, and charging a data voltage onto a second sub-pixel unit by supplying a gate high voltage to a second thin film transistor connected to an nth gate line, wherein a gate low voltage, which is lower than the gate high voltage, is supplied to the (n−1)th gate line when the data voltage is charged onto the second sub-pixel unit.

In another aspect, a line-on-glass liquid crystal display device includes a substrate having a display area with sub-pixel units and a non-display area; data lines for supplying data signals to drive sub-pixel units in the display area; gate lines for supplying gate signals to the sub-pixel units in the display area; and a gate low voltage stabilization circuit in the non-display area for applying a gate low voltage signal to the sub-pixel units.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
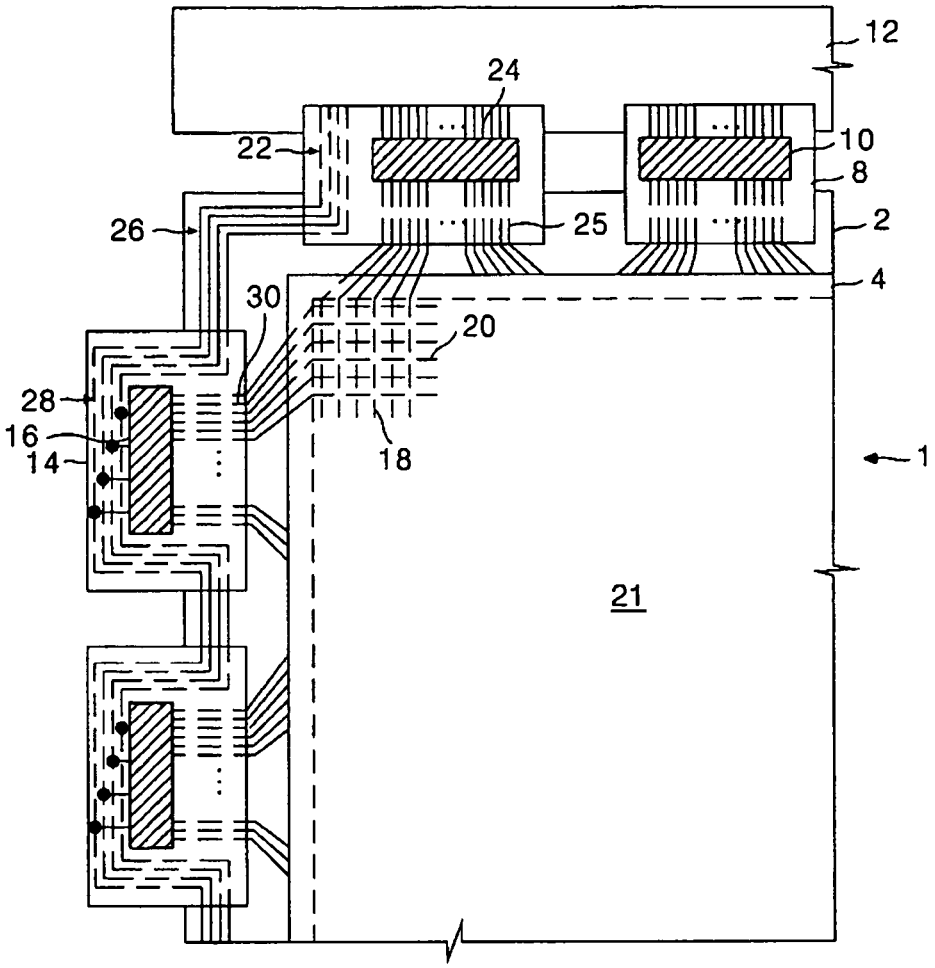
FIG. 1 RELATED ART
FIG. 1 is a plan view of a line-on-glass liquid crystal display device of the related art.
Figure 2:
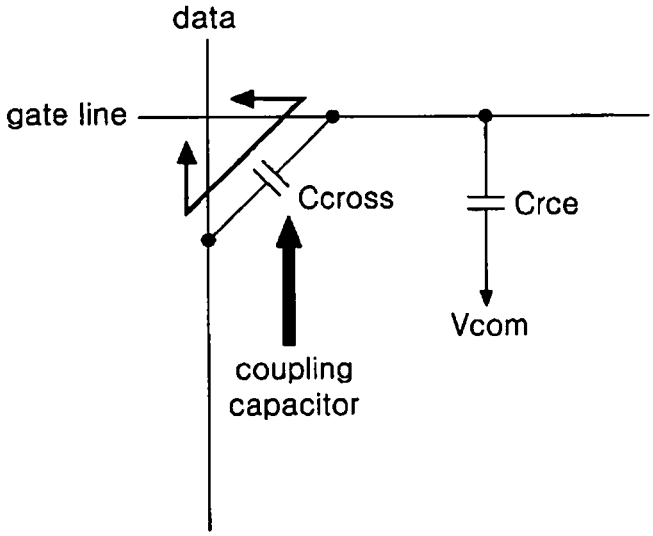
FIG.2 RELATED ART
FIG. 2 is an equivalent circuit of a vertically adjacent gate line and a data line of sub-pixel in a related art liquid crystal display device.
Figure 3:
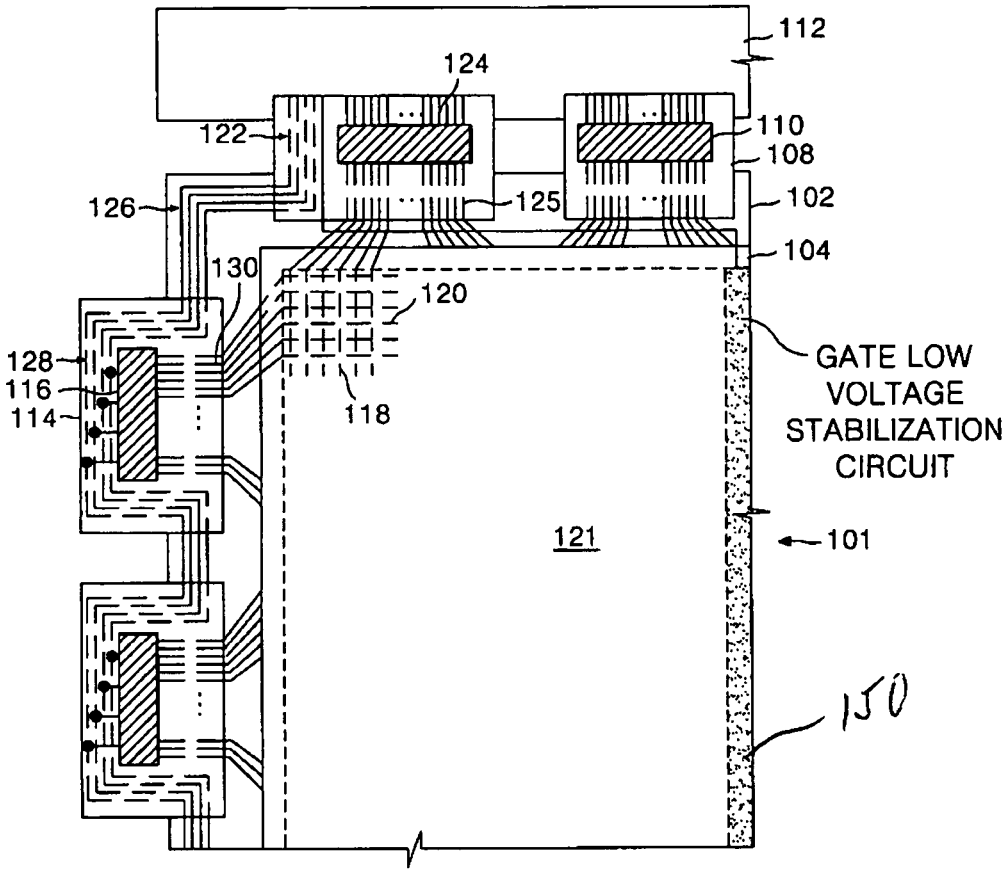
FIG. 3 is a plan view of a line-on-glass liquid crystal display device according to an embodiment of the present invention.

FIG. 3 is a plan view of a line-on-glass liquid crystal display device according to an embodiment of the present invention. As shown in FIG. 3, a liquid crystal display device where LOG signal lines are used instead of the gate PCB according to an embodiment of the present invention includes: a liquid crystal display panel 101; a plurality of data TCP's 108 connected between the liquid crystal display panel 101 and the data PCB 112; a plurality of gate TCP's connected to another side of the liquid crystal display panel 101; data drive IC's 110 mounted on the data TCP's 108 respectively; and gate drive IC's 116 mounted on the gate TCP's 114 respectively.

The liquid crystal display panel 101 includes a lower substrate on which a thin film transistor array is formed together with various signal lines; an upper substrate on which a color filter array is formed; and a liquid crystal injected between the lower substrate 102 and the upper substrate 104. In such a liquid crystal display panel 101, there is provided a picture display area 121 having sub-pixel units provided in areas between the crossing gate lines 120 and data lines 118. In an outer area of the lower substrate 102, which is located at an outer part of the picture display area 121, data pads connected to the data lines 118 and gate pads connected to the gate lines 120 are provided. Further, a LOG signal line group 126 for transmitting the gate drive signals, which are supplied to the gate drive IC 116, is provided in the outer area of the lower substrate 102.

The data drive IC 110 is mounted on the data TCP 108, and input pads 124 and output pads 125 electrically connected to the data drive IC 110 are formed on the data TCP 108. The input pads 124 of the data TCP 108 are electrically connected to the output pads of the data PCB 112 through an anisotropic conductive film (hereinafter, referred to as 'ACF'), and the output pads 125 are electrically connected to the data pads on the lower substrate 102 through the ACF. A gate drive signal transmission group 122 electrically connected to the LOG signal line group 126 on the lower substrate 102 is also provided on a first data TCP 108. The gate drive signal transmission group 122 supplies the gate drive signals supplied from the timing controller and the power supply to the LOG signal line group 126 from the data PCB 112. The first data TCP 108 also includes a line for applying a gate low voltage signal from the data PCB 112 to a gate low voltage stabilization circuit of switch devices corresponding to each gate line. The data drive IC's 110 convert the pixel data signal from a digital signal into a pixel voltage signal, which is an analog signal, and then supplies the pixel voltage signal as a data voltage to the data lines 118 of the liquid crystal display panel.

The gate drive IC 116 is mounted on the gate TCP 114, and a gate drive signal transmission line group 128 and output pads 130 are electrically connected to the gate drive IC 116 provided on the gate TCP 114. The gate drive signal transmission line group 128 is electrically connected to the LOG signal line group 126 on the lower substrate 102 through the ACF, and the output pads 130 are electrically connected to the gate pads on the lower substrate 102 through the ACF. The gate drive IC's 116 sequentially supply a scan signal, such as a gate high voltage signal VGH, to the gate lines 120 in response to the input control signals. Further the gate drive IC's 116 supply a gate low voltage signal VGL to the gate lines, except for the period when the gate high voltage signal VGH is supplied.

The LOG signal line group 126 includes signal lines that supply DC voltage signals from the power supply, such as the gate high voltage signal VGH, the gate low voltage signal VGL, a common voltage signal VCOM, a ground voltage signal GND and a power voltage signal VCC. Further, the LOG signal line group 126 also includes signal lines that supply gate control signals from the timing controller, such as a gate start pulse GSC, a gate shift clock signal GSC and a gate enable signal GOE.

Figure 4:
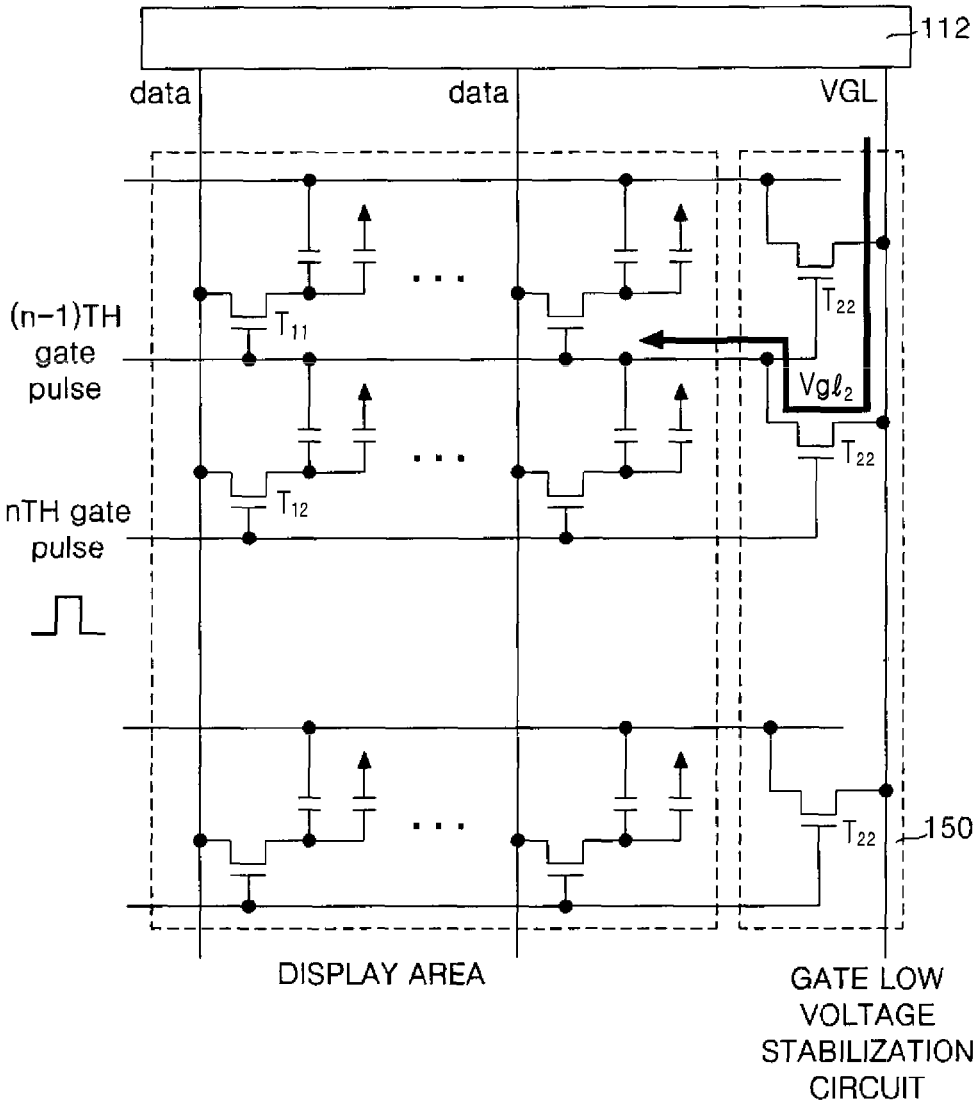
FIG. 4 is a circuit diagram representing a sub-pixel unit according to an embodiment of the present invention.

FIG. 4 is a circuit diagram representing a sub-pixel unit according to an embodiment of the present invention. As shown in FIG. 4, a gate low voltage stabilization circuit 150 having a thin film transistor TFT T22 corresponding to each of the gate lines is formed on one side of the outer part of the picture display area 121. The TFT T22 of the gate low voltage stabilization circuit 150 connects the (n−1)th gate line and a gate drive signal line VGL of the data PCB 112 while the nth gate line receives the gate high voltage signal VGH. In contrast, the gate low voltage line of the related art has the load of the whole panel. In other words, in the related art, all gate lines except for the gate line to which a gate high voltage signal is applied are connected to the gate low voltage line. Thus, a return current caused by a parasitic capacitor becomes large because the gate low voltage signal is applied to all the gate lines except for the line to which the gate high voltage signal is applied.

Figure 5:
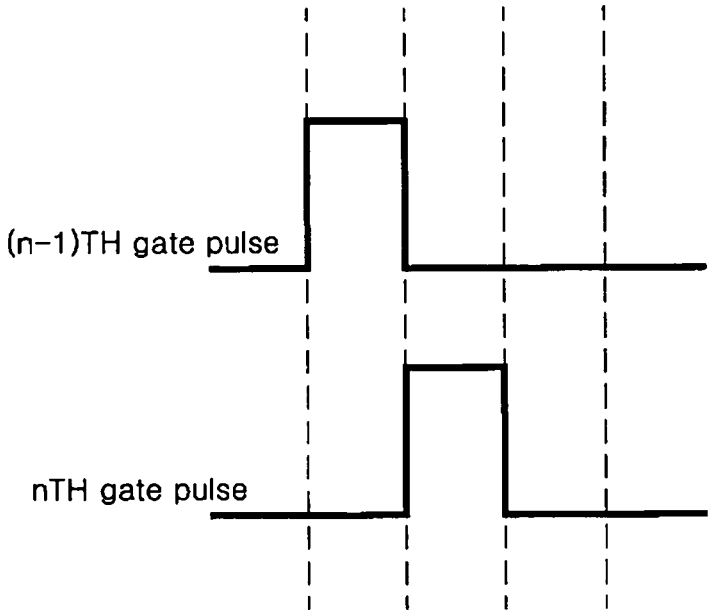
FIG. 5 is a diagram representing a stabilized gate low voltage signal according to an embodiment of the present invention.

FIG. 5 is a diagram representing a stabilized gate low voltage signal according an embodiment of the present invention. The gate low voltage stabilization circuit 150 of an embodiment of the present invention supplies a second gate low voltage signal Vgl2 to the (n−1)th line if the TFT T22 is on. Accordingly, the second gate low voltage signal Vgl2 only has the load corresponding to the (n−1)th line to minimize the return current, thus it is possible to stably supply the second gate low voltage signal Vgl2, as shown in FIG. 5.

As described above, the LOG liquid crystal display device according to embodiments of the present invention can stably supply the gate low voltage signal, thereby improving display quality. Hereinafter, a driving method of the LOG liquid crystal display device according to and embodiment of the present invention described above will be explained in reference to FIG. 4.

First, the gate high voltage is supplied to a first thin film transistor T11, which is connected to the (n−1)th gate line, thereby charging a data voltage onto a first sub-pixel unit. Next, the gate high voltage is supplied to a second thin film transistor T12, which is connected to the nth gate line, thereby charging a data voltage onto a second sub-pixel unit positioned under the first sub-pixel unit.

The gate low voltage stabilization circuit 150 includes several switching devices, such as TFTs T22 A source of each of the switching devices is connected to a gate low voltage line 151 that provides a gate low voltage VGL, which is lower than the gate high voltage. The gate low voltage is from the data PCB 112. Further, a drain electrode of each of the switch devices T22 is connected to the (n−1)th gate line. Further, a gate electrode of each of the switch devices T22 is connected to the nth gate line. Accordingly, while the nth gate line is charged with the gate high voltage, the (n−1)th gate line is maintained at the gate low voltage such that no return current is generated in the (n−1)th gate line.

According to another embodiment of the present invention described above, there is an advantage in that the gate drive IC can be designed more simply. That is to say, because the gate low voltage signal VGL can be applied by the gate low voltage stabilization circuit, the gate drive IC only needs to simply provide the gate high voltage signal VGH, thus the gate drive IC can be designed more simply.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A line-on-glass liquid crystal display device, comprising:

data lines for supplying data signals to drive sub-pixel units on a first substrate;

gate lines for supplying gate signals to the sub-pixel units in which each of the gate lines has a first end and a second end such that the gate lines cross the data lines between the first and second ends;

a plurality of gate integrated circuits at the first end of each of the gate lines for supplying a gate high voltage signal to one of the gate lines, and for supplying a gate low voltage signal to the other gate lines;

a gate low voltage stabilization circuit at the second end of each of the gate lines and connected to a gate low voltage line from a data printed circuit board for applying a second gate low voltage signal to one of the other gate lines;

a plurality of drive integrated circuits mounted on each of tape carrier packages between the printed circuit board and the first substrate for supplying drive signals to the data lines;

a storage capacitor formed on each of the sub-pixel units, wherein the storage capacitors of nth sub-pixel units are formed between pixel electrodes of nth sub-pixel units and (n−1)th gate line; and a second substrate including a color filter array, wherein the gate low voltage stabilization circuit is connected to the gate low voltage line on the data printed circuit board via the tape carrier package, wherein the gate low voltage stabilization circuit includes switching devices connected to the second end of each of the gate lines, wherein the switching device for a corresponding (n−1)th gate line is turned on when a gate high voltage signal is applied to an nth gate line so that the second gate low voltage signal is applied to the (n−1)th gate line which is a storage electrode of the storage capacitor corresponding with the nth sub-pixel unit, wherein the second gate low voltage signal is supplied to the switching devices via the tape carrier package from the data printed circuit board, wherein the switching devices are thin film transistors, and wherein each of the thin film transistors include a drain electrode connected to the (n−1)th gate line, a gate electrode connected to the nth gate line, and a source electrode connected to the gate low voltage line, wherein the gate electrode of each of the thin film transistors is connected to the second end of the gate line of a same stage, wherein the (n−1)th gate line is a line corresponding to the (n−1)th sub-pixel units driven by the data signals before the nth sub-pixel units corresponding to the nth gate line, and wherein the gate low voltage stabilization circuit is disposed between the first substrate and the second substrate, and wherein the data lines and the gate low voltage line are commonly connected to the data printed circuit board.

2. A line-on-glass liquid crystal display device, comprising:

a first substrate having a display area with sub-pixel units and a non-display area;

data lines for supplying data signals to drive sub-pixel units in the display area;

gate lines for supplying gate signals to the sub-pixel units in which each of the gate lines has a first end and a second end such that the gate lines cross the data lines between the first and second ends;

a plurality of gate integrated circuits at the first end of each of the gate lines for supplying a gate high voltage signal to one of the gate lines, and for supplying a gate low voltage signal to the other gates lines;

a gate low voltage stabilization circuit at the second end of each of the gate lines and in the non-display area for applying a second gate low voltage signal to one of the other gate lines;

a plurality of drive integrated circuits mounted on each of tape carrier packages between the data printed circuit board and the first substrate for supplying drive signals to the data lines; and a storage capacitor formed on each of the sub-pixel units, wherein the storage capacitors of nth sub-pixel units are formed between pixel electrodes of nth sub-pixel units and (n−1)th gate line; and a second substrate including a color filter array, wherein the gate low voltage stabilization circuit is connected to the gate low voltage line on the data printed circuit board via the tape carrier package, wherein the gate low voltage stabilization circuit includes switching devices connected to the second end of each of the gate lines, wherein the switching device for a corresponding (n−1)th gate line is turned on when a gate high voltage signal is applied to an nth gate line so that the second gate low voltage signal is applied to the (n−1)th gate line which is a storage electrode of the storage capacitor corresponding with the nth sub-pixel unit, and wherein the second gate low voltage signal is supplied to the switching devices via the tape carrier package from the data printed circuit board, wherein the switching devices are thin film transistors, and wherein each of the thin film transistors include a drain electrode connected to the (n−1)th gate line, a gate electrode connected to the nth gate line, and a source electrode connected to the gate low voltage line, wherein the gate electrode of each of the thin film transistors is connected to the second end of the gate line of a same stage, wherein the (n−1)th gate line is a line corresponding to the (n−1)th sub-pixel units driven by the data signals before the nth sub-pixel units corresponding to the nth gate line, and wherein the gate low voltage stabilization circuit is disposed between the first substrate and the second substrate, and wherein the data lines and the gate low voltage line are commonly connected to the data printed circuit board.

* * * * *